US005651246A

United States Patent [19]

Kusaba

[11] Patent Number: 5,651,246

[45] Date of Patent: Jul. 29, 1997

[54] METHOD OF PRODUCTION OF STEEL CORD FOR REINFORCING PRODUCTS HAVING A FLAT SECTION

[75] Inventor: Noboru Kusaba, Tochigi-ken, Japan

[73] Assignee: Bridgestone Metalpha Corporation, Tokyo, Japan

[21] Appl. No.: 729,093

[22] Filed: Oct. 15, 1996

Related U.S. Application Data

[63] Continuation of Ser. No. 358,437, Dec. 19, 1994, abandoned.

[30] Foreign Application Priority Data

Dec. 19, 1993 [JP] Japan ..... 5-344204

[51] Int. Cl.[6] ..... D01H 13/26; D02G 3/36

[52] U.S. Cl. ..... 57/311; 57/9; 57/200; 57/237; 57/902

[58] Field of Search ..... 57/9, 200, 237, 57/311, 902

[56] References Cited

U.S. PATENT DOCUMENTS

| | | | |
|---|---|---|---|
| 627,258 | 2/1899 | Hallidie | 57/9 |
| 4,385,486 | 5/1983 | Iwata et al. | 57/902 |
| 4,718,470 | 1/1988 | Kusakabe et al. | 57/902 |
| 4,938,015 | 7/1990 | Kinoshita | 57/902 |
| 5,162,067 | 11/1992 | Miyawaki | 152/451 |
| 5,223,060 | 6/1993 | Imamiya et al. | 57/902 |

FOREIGN PATENT DOCUMENTS

| | | | |
|---|---|---|---|
| 6-10280 | 1/1994 | Japan | 57/902 |
| 6-10282 | 1/1994 | Japan | 57/902 |
| 6-65877 | 3/1994 | Japan | 57/902 |

*Primary Examiner*—William Stryjewski
*Attorney, Agent, or Firm*—Jordan and Hamburg

[57] ABSTRACT

A method for producing a steel cord from 3 to 6 steel filaments on which a coating is applied to retain the adhesion to a rubber, the steel cord being destined for use to reinforce a rubber product having a flat section, comprising the following steps of preforming steel filaments at a ratio of more than 120% by twisting them together to form an open-structure steel cord; and passing the steel cord through a flattening apparatus provided at each of outlet and inlet thereof with a roller having a groove formed in the center of the circumference thereof, and between the inlet and outlet rollers with at least a roller of which the circumferential surface is flat, to repeatedly bend the steel cord vertically or horizontally.

12 Claims, 6 Drawing Sheets

METHOD OF PRODUCTION OF STEEL CORD FOR REINFORCING PRODUCTS HAVING A FLAT SECTION

This application is a continuation of application Ser. No. 08/358,437 filed Dec. 19, 1994, now abandoned.

BACKGROUND OF THE INVENTION

1. Field of the Invention

The present invention relates to a method for rubber products such as pneumatic lyres, industrial-use belts, etc.

2. Prior-art Statement

To improve the durability of rubber products reinforcing steel cords as buried in the rubber product. Furthermore, it is known to produce a single-twist open-structure steel cord for use as buried in a rubber product which is to be reinforced. In this steel cord, the rubber is penetrated into gaps between steel filaments in the reinforcing steel cord to prevent the steel filaments from being corroded by water.

In the single-twist open-structure steel cord, however, the mutual binding of the steel filaments forming together the steel cord is weak, so the cord is easily elongated even with a small force applied to the steel cord. So, during fabrication of a rubber product in which the steel cords are buried, it is diffucult for the molded rubber product to retain its dimensions in all conditions.

To overcome the drawbacks of the single-twist open-structure steel cord, a single-twist open-structure steel cord has been proposed which has a general sectional shape of an ellipse. To this end, it has been proposed to produce such a steel cord by drawing a steel through an elliptic hole in a die or by pressing a steel cord once drawn through a die, by a group of correction rollers.

However, if a die having an elliptic hole is used to form such a single-twist open-structure steel cord of which the sectional shape is generally elliptic, the contact friction of the steel cord with the die will separate a coating applied on the surface of the steel filaments to keep the adhesion to the rubber, resulting in a reduction of the adhesion, and will also cause a scratch on the surface of the steel filaments, resulting in a reduced strength and fatigue resistance of the steel cord.

On the other hand, if the rollers used in the above-mentioned pressing are rotatable, the friction of the rollers with the steel cord is reduced so that the separation of the adhesion retaining coating and scratch to the steel filaments are reduced. However, if it is tried to produce a steel cord having an elliptic sectional shape of which the ratio between the long and small diameters is large, the rollers should impart a large deflection to the steel cord with a result that the steel cords will be unevenly twisted at some portions thereof and thus the steel cords will be waved.

For the sectional shape of the steel cord to be made elliptic by the group of correction rollers, the steel cord are to be pressed from at least 4 directions, so that the ratio between the large and small diameters of the elliptic section is limited to a certain range, and so no desirable. elliptic sectional shape can be obtained.

SUMMARY OF THE INVENTION

The present invention has an object to overcome the above-mentioned drawbacks of the prior art by providing a novel and improved method for production of a steel cord for reinforcing products having a flat section.

The above object is accomplished by providing a method for producing a steel cord from 3 to 6 steel filaments each with a coating applied to retain the adhesion to a rubber, the steel cord being for reinforcing a rubber product having a flat section, comprising the following steps of preforming steel filaments at a ratio of more than 120% or preferably less than 200%; twisting them together to form an open-structure steel cord; and passing the steel cord through a flattening apparatus provided at each of an outlet and an inlet thereof with a roller having a groove formed in the center of the circumference thereof, and between the inlet and outlet rollers with at least a roller of which the circumference is flat, to repeatedly bend the steel cord vertically or horizontally.

According to the present invention, the steel filaments are preformed at a ratio of more than 120% in order to flatten a steel cord having a circular sectional form. If the preforming is less than 120%, the steel filaments forming together a steel cord cannot be freely deformed and it is difficult to flatten a steel cord having a circular section.

On the other hand, if the preforming ratio is more than 200%, the diameter of the steel cord is about 2 times larger than that of any closed-structure steel cord in which adjacent steel filaments are in contact with each other so that the number of steel cords which can be buried in a rubber product is nearly halved, resulting in a reduced reinforcement of the rubber product.

The preforming ratio referred to herein is as will he described below. It is assumed that a diameter of a spiral defined by a center of one of adjacent steel filaments in a closed-structure steel cord in which the steel filaments are in contact with each other and their centers lie on a same circle, is 100%. A diameter of a spiral defined by a center of one of adjacent steel filament in an open-structure steel cord in which the steel filaments are spaced from each other and their centers lie on a same circle, is represented in a percentage with respect to the spiral diameter of the closed-structure steel cord.

According to the present invention, a bending unit having the grooveless rollers provided between the inlet and outlet grooved rollers to repeatedly bend the steel cord in two directions, is used to flatten the steel cord to a desired flatness, thereby producing a steel cord demonstrating reduced elongation under a small weight, in which a rubber can easily penetrate into spacings between steel filaments thereof and which has excellent adhesion to the rubber.

DETAILED DESCRIPTION OF THE PREFFERRED EMBODIMENTS

Figure 1:
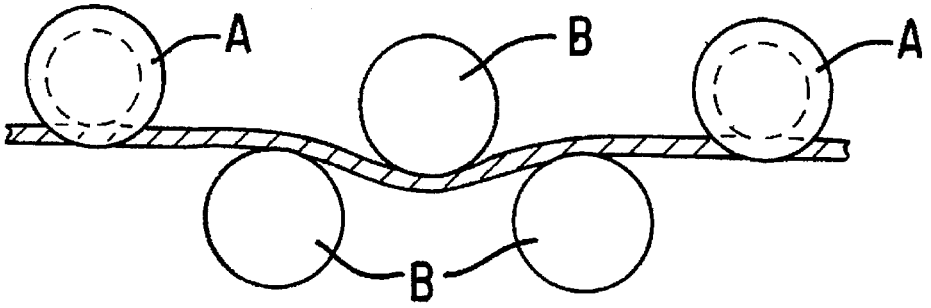
FIG. 1 is a plan view of the essential part of the flattening apparatus used in the present invention and provided with a grooved roller at either end thereof and three grooveless rollers between the end rollers.

First, the buncher type twisting machine will be described in reference to FIG. 7. Three steel filaments $W_0$ unwound from a supply reel 1 are preformed by a preforming unit 2 into a steel cord twisted to a spiral of 150% in preforming ratio, and the steel cord thus formed is further twisted by a flying bow 3, subjected to a correction in twisted state by an over-twisting unit 4, and flattened by a flattening apparatus 20 provided between a guide capstan 5 and traverse 6 to repeatedly bend the steel cord, and the steel cord W thus flattened is taken up onto a take-up reel 7.

According to the present invention, the number of steel filaments forming together a steel cord is limited to a range of 3 to 6 for the following reasons. Namely, if a single steel filament is used, it is surrounded all around in a rubber product. In case two steel filaments are used to form a steel cord, their mutual binding in the steel cord is so weak that they will be elongated even when a slight weight is applied to the steel cord, which will cause a dimensional problem in the rubber product.

On the other hand, if more than 6 steel filaments are used to form together a steel cord, one or more of them will come to the center of the steel cord and cause it to be impossible to flatten the steel cord to a desired flatness.

Figure 7:
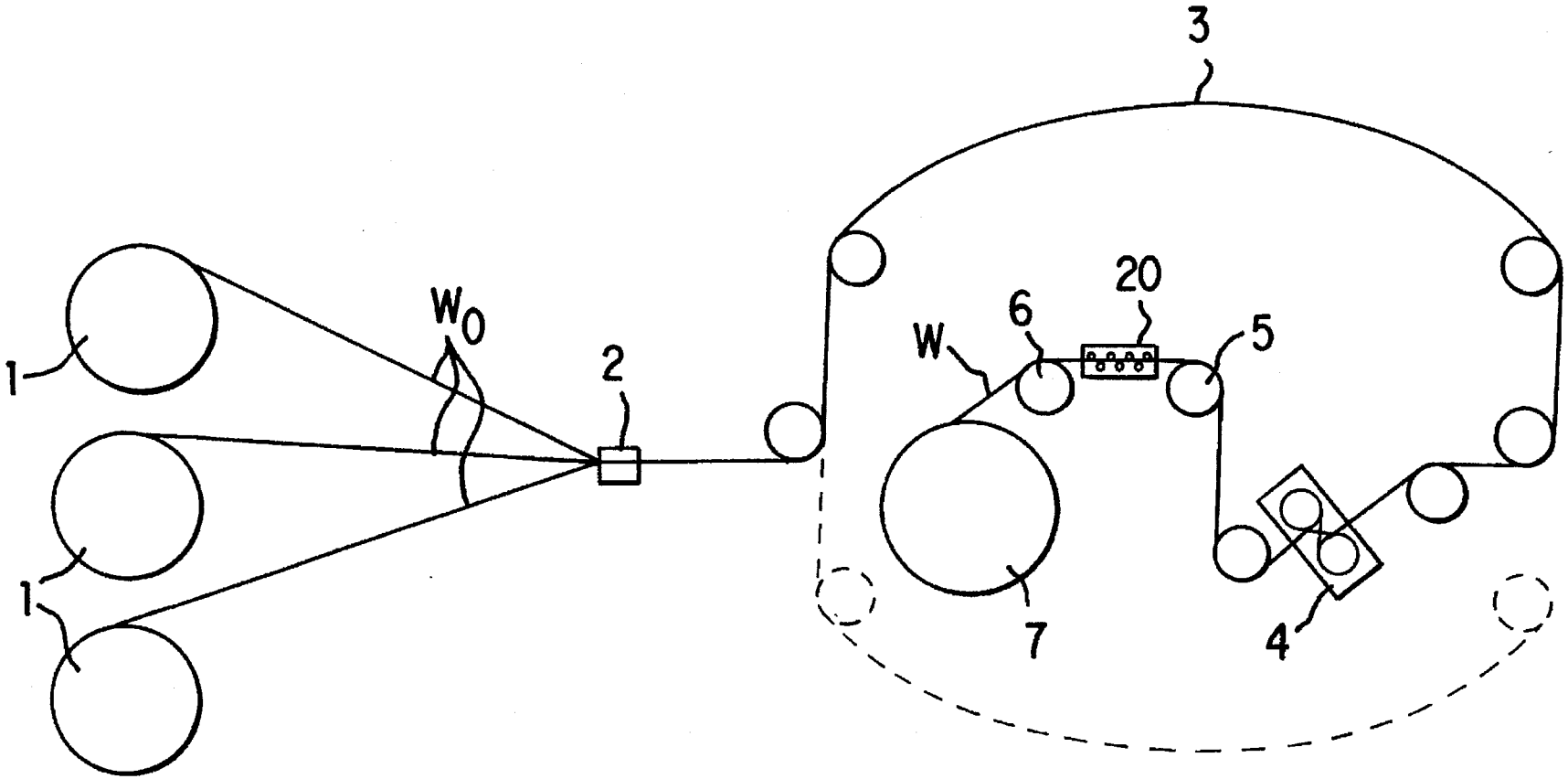
FIG. 7 is an explanatory drawing of the manufacturing process according to the present invention using a buncher type twisting machine.
Figure 8:
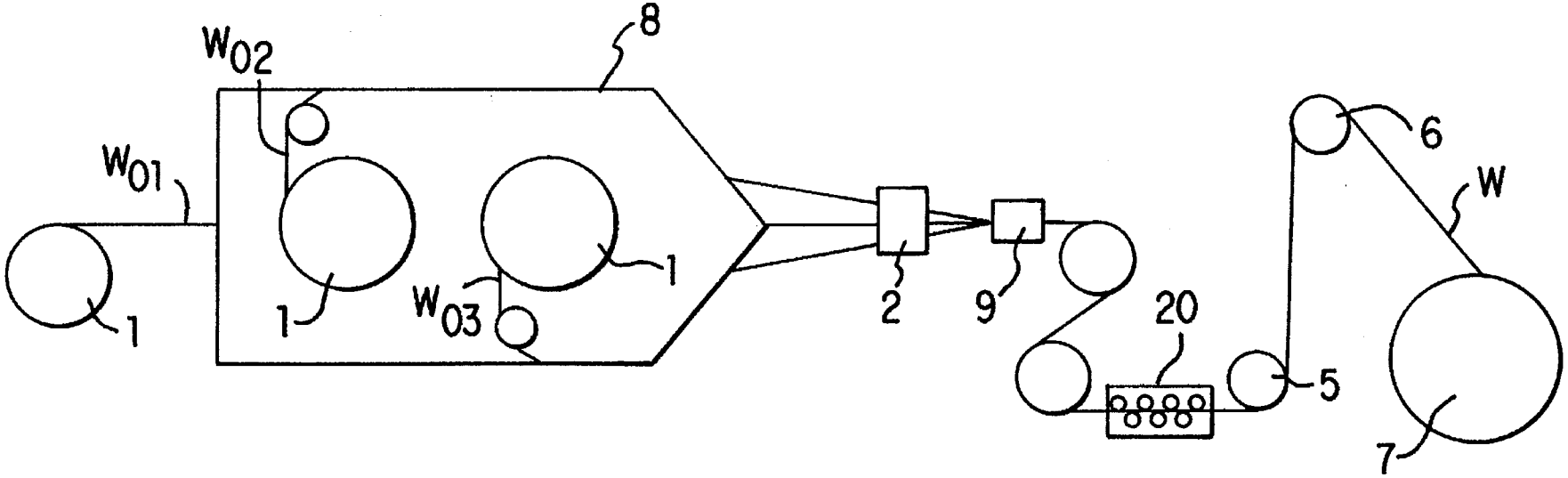
FIG. 8 is an explanatory drawing of the manufacturing process according to the present invention using a tubular type twisting machine.

Note that the method according to the present invention can be carried out by either the buncher type double-twisting machine as shown in FIG. 7 or the tubular type twisting machine which will be described below in reference to FIG. 8.

The tubular type twisting machine will be explained herebelow referring to FIG. 8. Three steel filaments $W_{01}$, $W_{02}$ and $W_{03}$ are drawn out from their respective supply reels 1. One $W_{01}$ of the steel filaments is passed through a tubular 8, while the other two $W_{01}$ and $W_{02}$, unwound from their respective reels 1, are guided along grooves (not shown) formed in the outer surface of the tubular 8. All these steel filaments $W_{01}$, $W_{02}$ and $W_{03}$ are taken to a preforming unit 2 through which they are preformed to a spiral of 150% in preforming ratio, and then twisted together by a cabling die 9 into a steel cord. The steel cord thus formed is passed through a flattening apparatus 20 which repeatedly bends the steel cord. The steel cord thus flattened is passed onto the guide capstan 5 and traverser 6. The steel cord W, having left the traverser 6, is taken up onto the take-up reel 7.

Figure 9:
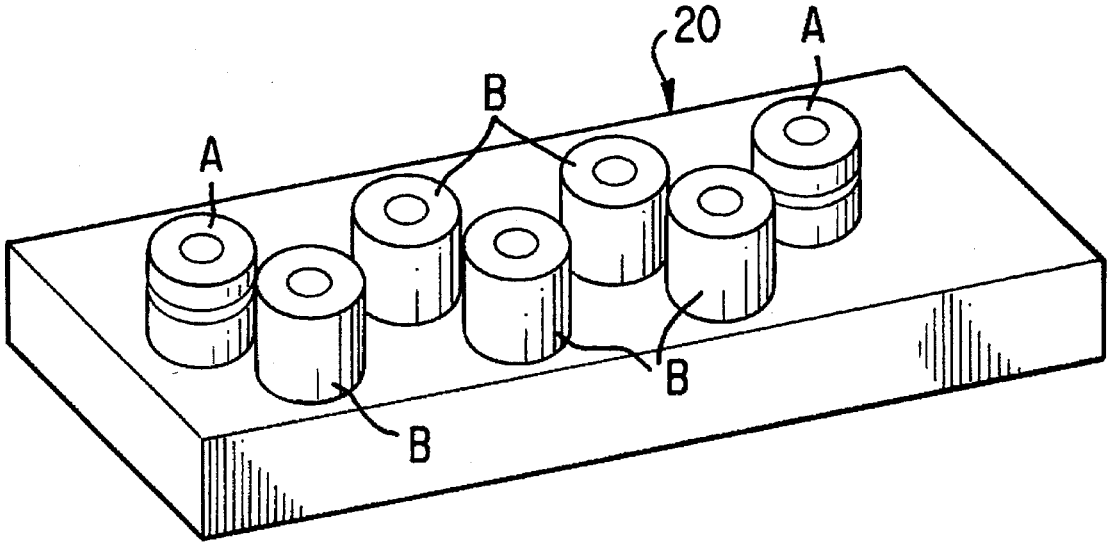
FIG. 9 is a perspective view of an example of flattening apparatus which repeatedly flattens a steel cord according to the present invention.

An example of the flattening apparatus 20 which repeatedly bends the steel cord, which is the most important process in the method according to the present invention, will be shown in FIG. 9. In this example, 7 rollers are used, of which the rollers A at the steel cord inlet and outlet, respectively, are grooved ones while the other five rolers B between the inlet and outlet rollers A are grooveless ones of which the circumference is flat.

For producing a steel cord of, for example, 1×30×0.30 structure, a flattening apparatus with rollers having a diameter of 16 mm and spaced 10 mm from one another, is used.

In case a steel cord is drawn through a die having an elliptic hole to flatten the steel cord as in the conventional process, the steel filament sufaces are damaged causing a reduction of the adhesion to the rubber. The adhesion of the steel cord produced by the conventional method is 60 under the assumption that the adhesion of the steel cord produced according to the present invention is 100. Also under the assumption that the fatigue resistance of the steel cord produced according to the present invention is 100 (index), that of the steel cord produced by the conventional method is 70. It is evident to those skilled in the art that the present invention is definitely advantageous over the conventional method.

Note that the present invention is not applicable to such steel cords having applied on the surfaces of the steel filaments thereof no coating to retain the adhesion to the rubber, for the steel cord can be produced by drawing through a die with an elliptic hole formed therein.

According to the present invention, a groove is formed in the center of the circumference of each of the inlet and outlet rollers of the flattening apparatus which bends the steel cord in two directions, in order to move the steel cord axially and limit the displacement of the twist of the steel cord due to the bending of the latter to thereby prevent the twisting pitch from being nonuniform.

Furthermore, the circumferences of the rollers between the inlet and outlet rollers of the flattening apparatus are made flat with no grooves formed therein for the following reasons.

FIG. 1 shows a flattening apparatus having a grooved roller A provided at either end thereof and three grooveless rollers B provided between the end rollers A. Fla. 2 shows the ratio of the deflection factor with the large diameter $D_1$ and small diameter $D_2$ of the steel cord having been passed through the flattening apparatus shown in FIG. 1, namely, the flatness of the steel cord.

Figure 2:
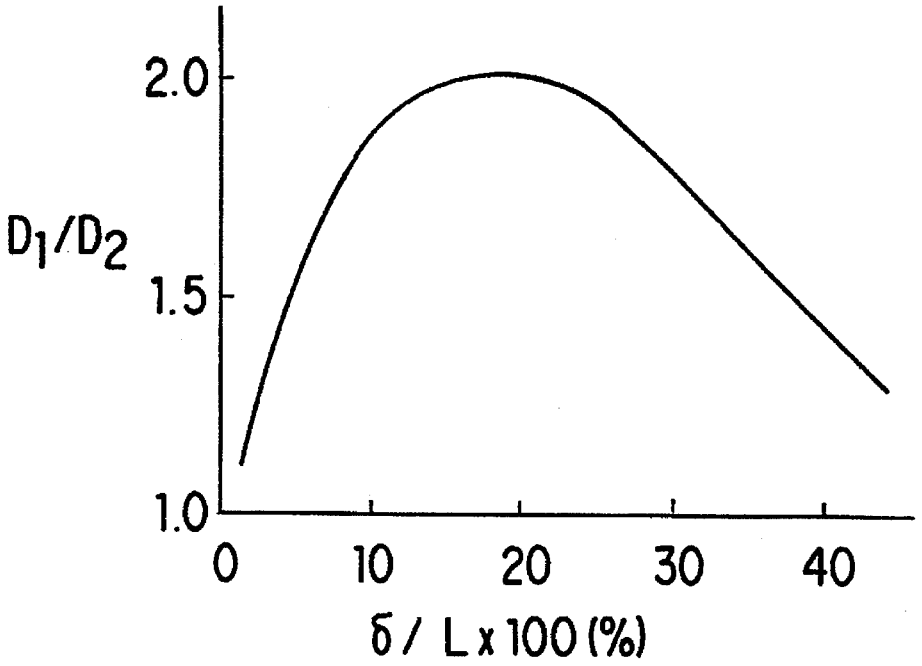
FIG. 2 graphically shows the relation between the deflection and flatness of the steel cord having been passed through the flattening apparatus shown in FIG. 1.
Figure 3:
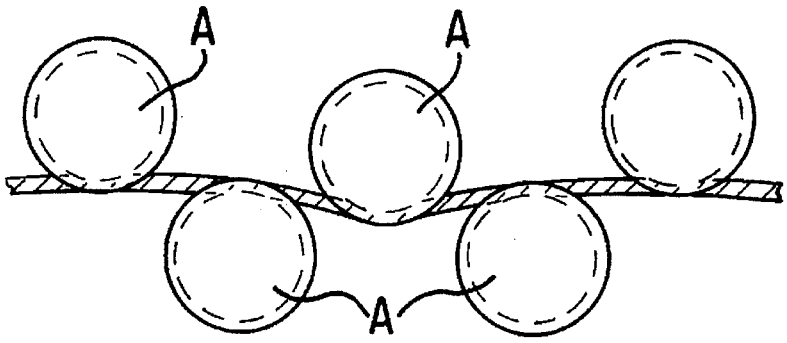
FIG. 3 is a plan view of an essential part of a flattening apparatus in which all the rollers are grooved ones.

FIG. 3 shows a flattening apparatus of which all the rollers A are grooved ones. Similar to FIG. 2, FIG. 4 shows the ratio of the deflection factor with the large and small diameters of the steel cord.

Figure 4:
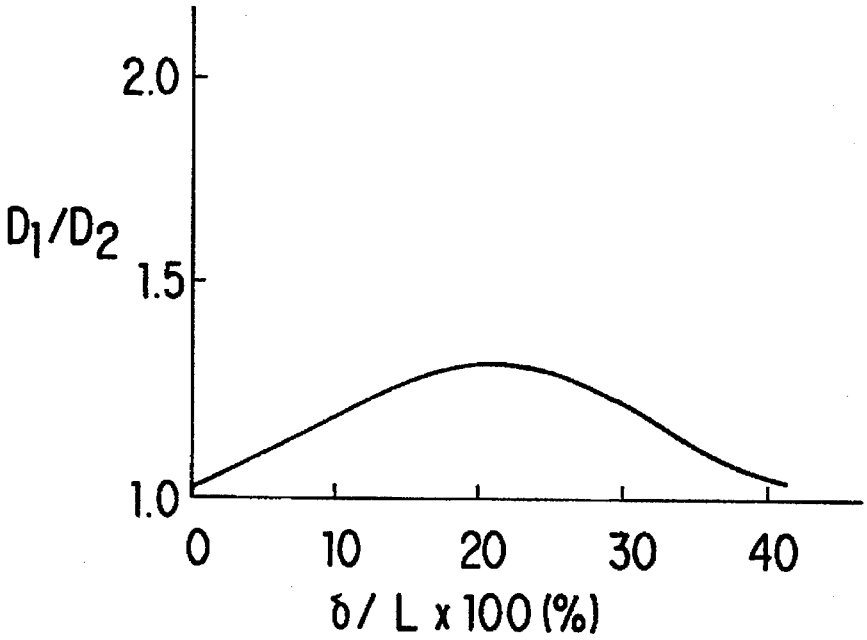
FIG. 4 graphically shows the relation between the deflection and flatness of the steel cord having been passed through the flattening apparatus shown in FIG. 2.

As definitely seen from the comparison between FIG. 2 and 4 among others, the grooveless rollers provided between the end rollers in the flattening apparatus contribute to a considerable change in flatness of the steel cord.

The graphs in FIGS. 2 and 4 show the results from the processes including the 150% preforming of three brass-plated steel filaments of 0.30 mm in diameter at a spiral pitch of 16 mm in an "S" direction, twisting of these steel filaments into a steel cord and the repeated bending of the steel cord by the flattening apparatus shown in FIGS. 1 and 3.

Figure 5:
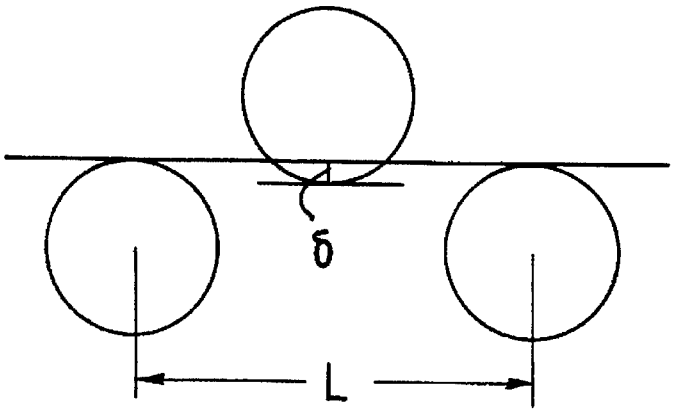
FIG. 5 shows the disposal of rollers provided between the end roller in the flattening device, define the deflection factor of the steel cord.
Figure 6:
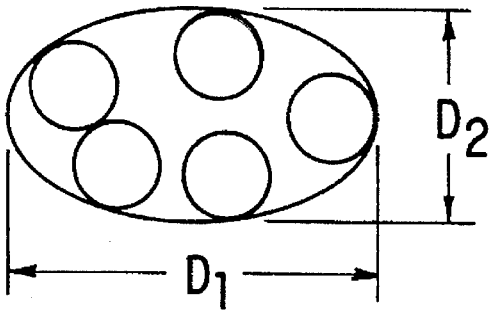
FIG. 6 is a sectional view of the steel cord defining the flatness of the steel cord.

The deflection factor (d/L×100%) of the steel cord is as shown in FIG. 5 which shows the relation between the intermediate rollers of the flattening apparatus. The flatness ($D_1/D_2$) of the steel cord is shown in FIG. 6.

As shown in FIG. 2, the flattening apparatus used in the method according to the present invention provides a wide range of flatness. However, since the process of flattening the steel cord by means of preforming rollers permits one to repeatedly bend the steel cord at least vertically and horizontally, it is difficult to flatten the steel cord to a desired extent. Similar to the repeated bending by grooved rollers as in the example in FIG. 3, the flattening by the correction rollers could not provide any steel cord of a desired flatness.

What is claimed is:

1. A method for production of a steel cord for reinforcing rubber product, comprising the steps of:

preforming three to six steel filaments, having a coating enhancing adhesion to rubber, to a preform ratio of 120% or more;

twisting together the coated steel filaments using a flying bow to form an open structure steel cord;

passing the steel cord over a guide capstan to a flattening apparatus;

receiving the steel cord from the flattening apparatus and traversing the steel cord across a width of a take-up reel winding the steel cord onto said take-up reel to effect even winding on said take-up reel; and in the flattening apparatus, passing the steel cord over inlet and outlet rollers provided at an inlet and an outlet of the flattening apparatus, respectively, said inlet and outlet rollers having a groove formed in a center of a circumferential surface of each of said inlet and outlet rollers for advancing said steel cord and limiting pitch displacement of the steel cord, and passing said steel cord over a total of a least three flat rollers provided immediately between the inlet and outlet rollers in a zigzag formation, at least one of the flat rollers being disposed at one side of the steel cord with at least the other two flat rollers being disposed on an opposite side of the steel cord to contact said steel cord at successive downstream positions thus repeatedly bending the steel cord.

2. The method according to claim 1 wherein said preform ratio is between about 120% and about 200%.

3. The method according to claim 1 wherein said preform ratio is about 150%.

4. A method for production of a steel cord, comprising the steps of:

preforming, at a ratio of 120% or more, three to six steel filaments on which a coating is applied to retain the adhesion to a rubber;

twisting together the coated steel filaments to form an open structure steel cord;

passing the steel cord over a guide capstan to a flattening apparatus provided following the guide capstan;

passing the steel cord over inlet and outlet rollers provided respectively at a steel cord inlet and outlet of the flattening apparatus, each of the inlet and outlet rollers having a groove formed in center of a circumferential surface thereof for advancing said steel cord and limiting pitch displacement of said steel cord;

passing the steel cord over a total of at least three flat rollers provided between the inlet and outlet rollers and contacting said steel cord at successive downstream positions downstream of said inlet roller, at least one of the flat rollers being disposed at one side of the steel cord and remaining ones of the at least three flat rollers being disposed at an opposite side of the steel cord and relative said at least one flat roller such that said steel cord travels a zigzag path and is repeatedly bent while passing over the flat rollers; and traversing the steel cord across a width of a take-up reel while winding the steel cord onto said take-up reel to effect even winding of the steel cord on the take-up reel.

5. A method for flattening steel cord having an oven structure comprising the steps of:

advancing and limiting pitch displacement of said steel cord using a grooved inlet roller;

flattening the steel cord by bending the steel cord over at least three flat rollers disposed to successively contact said steel cord at positions downstream from said grooved inlet roller in a pattern defining a path of travel for said steel cord redirected in opposing directions by each successive flat roller thereby forming a zig zag path; and advancing and limiting pitch displacement of said steel cord using a grooved outlet roller disposed downstream of said flat rollers and functioning in combination with said grooved inlet roller.

6. The method according to claim 5 wherein a preform ratio of said steel cord is between 120% and 200%.

7. The method according to claim 5 wherein a preform ratio of said steel cord preform ratio is about 150%.

8. The method according to claim 5 wherein said steel cord includes 3 to 6 filaments.

9. A method for production of a steel cord for reinforcing rubber products, comprising the steps of:

passing a first steel filament through a tube and passing at least two other steel filaments through grooves on an outside of said tube, each of said steel filaments being passed to a preformer and each having a coating for enhancing adhesion to rubber;

preforming said steel filaments to a preform ratio of 120% or more;

twisting together the coated steel filaments to form an open structure steel cord having an open structure and feeding said steel cord to a flattening apparatus;

in the flattening apparatus, passing the steel cord over inlet and outlet rollers provided at an inlet and an outlet of the flattening apparatus, respectively, said inlet and outlet rollers having a groove formed in a center of a circumferential surface of each of said inlet and outlet rollers for advancing said steel cord and limiting pitch displacement of the steel cord, and passing said steel cord over a total of a least three flat rollers provided immediately between the inlet and outlet rollers in a zigzag formation, at least one of the flat rollers being disposed at one side of the steel cord with at least the other two flat rollers being disposed on an opposite side of the steel cord to contact said steel cord at successive downstream positions thus repeatedly bending the steel cord over said flat rollers to flatten the steel cord; and receiving the steel cord from the flattening apparatus and traversing the steel cord across a width of a take-up reel while winding the steel cord onto said take-up reel to effect even winding on said take-up reel.

10. The method according to claim 9 wherein a preform ratio of said steel cord is between 120% and 200%.

11. The method according to claim 9 wherein a preform ratio of said steel cord preform ratio is about 150%.

12. The method according to claim 9 wherein said steel cord includes 3 to 6 filaments.

* * * * *